United States Patent [19]

Fournier

[11] 4,154,303

[45] May 15, 1979

[54] VALVE ASSEMBLY FOR CONTROLLING LIQUID FLOW IN A WELLBORE

[75] Inventor: Onazip J. Fournier, Pauls Valley, Okla.

[73] Assignee: The Dow Chemical Company, Midland, Mich.

[21] Appl. No.: 877,443

[22] Filed: Feb. 13, 1978

[51] Int. Cl.[2] ..... E21B 43/00; E21B 43/26

[52] U.S. Cl. ..... 166/317; 166/318; 166/319; 166/323; 166/325

[58] Field of Search ..... 166/316, 317, 318, 319, 166/325, 332, 323, 308, 177; 137/467

[56] References Cited

U.S. PATENT DOCUMENTS

| | | | |
|---|---|---|---|
| 2,162,578 | 6/1939 | Hacker | 166/325 X |
| 2,416,842 | 3/1947 | O'Leary | 166/316 X |
| 2,853,265 | 9/1958 | Clark, Jr. | 166/331 X |
| 2,874,927 | 2/1959 | Conrad | 166/334 X |
| 3,013,612 | 12/1961 | Angel | 166/325 |
| 3,338,312 | 8/1967 | Scott | 166/331 |
| 3,470,903 | 10/1969 | Scott | 137/467 |
| 4,002,202 | 1/1977 | Huebsch et al. | 166/316 X |

*Primary Examiner*—Stephen J. Novosad
*Attorney, Agent, or Firm*—V. Dean Clausen

[57] ABSTRACT

The valve assembly disclosed herein is used primarily in oil or gas well servicing to prevent contamination of fluids used to treat the formation. The valve is coupled into a tubing string, and it includes a slidable hollow mandrel, with a hingable flapper disk positioned below the mandrel. The valve is generally used in cooperation with a packer tool and bridge plug. When treating fluid is pumped down the tubing string it pushes the flapper disk open and holds it open, so the fluid can reach the formation interval being treated. To treat the next higher interval the packer is unset to raise the tubing string. Releasing the packer allows residual fluids to backflow from the well casing annulus into the tubing string. In this tool the backflowing fluid closes the flapper, so that it acts as a check valve to prevent contamination of the treating fluid. Before the valve is pulled out of the casing the mandrel is slid downwardly, to push the flapper open and hold it in open position.

4 Claims, 4 Drawing Figures

VALVE ASSEMBLY FOR CONTROLLING LIQUID FLOW IN A WELLBORE

BACKGROUND OF THE INVENTION

Broadly, the invention relates to a valve for controlling fluid flow in a wellbore. More specifically, the invention is directed to a valve assembly useful for controlling liquid flow between a well casing and a tubing string positioned in the casing.

In the production of oil and gas various techniques are used to enhance recovery of the petroleum product from earth formations having low permeability. Hydraulic fracturing is an example of such a technique. This procedure involves pumping liquids under high pressure down the well casing and into the producing formation, which fractures the formation outwardly from the well casing. The fractures thus provide a larger surface area in the formation, to enable better drainage of the oil or gas into the well casing.

In a typical fracturing operation the liquid used to treat the formation is pumped down a tubing string suspended inside of the well casing. Residual fluids, such as drilling mud, salt water, and the like, remain in the casing after the well is drilled and the casing is cemented into the borehole. When the tubing string is lowered into the casing these residual fluids become trapped in the annulus between the tubing string and the well casing. During a fracturing operation the fluids in the casing annulus can backflow into the tubing string and mix with the fracturing (treating) fluid. This is an undesirable situation, in that the residual fluids can contaminate the fracturing fluid and destroy the intended purpose of the treatment. The valve assembly of this invention provides a tool which allows fluid to be pumped down the tubing string, and at the same time prevents fluid in the casing annulus from backflowing into the tubing string.

SUMMARY OF THE INVENTION

The valve assembly of this invention is used primarily to control fluid flow through a tubing string, as positioned in a well casing. Basic components of this valve assembly include a top coupling, a bottom coupling, a sleeve, and a hollow mandrel. The upper end of the top coupling connects into a tubing string. Another section of tubing string connects into the bottom end of the bottom coupling. This valve assembly is generally used in conjunction with a well packer and a retrievable bridge plug, which are installed on the tubing string below the valve assembly.

The mandrel has a slidable fit inside the top coupling and the sleeve, whiich enables it to slide downwardly from a rest position to a latch position. The mandrel is held in rest position by one or more shear pins, which are mounted on the sleeve above the lower end of the mandrel. The valve includes a flapper disk, with a pivot pin and spring structure mounted on one side of the disk. The pin and spring define a hinge point, by which the disk is connected into the inner wall surface of the bottom coupling.

A central conduit is defined within the assembled combination of the top and bottom couplings, the sleeve, and the hollow mandrel. This conduit provides a passage for fluid to flow from one of the tubing strings, through the valve, and into the other tubing string. The hinge joint allows the flapper to move between a closed position, and an open position. In its closed position the flapper disk seats crosswise of the central conduit below the lower end of the mandrel. In open position the flapper disk swings downwardly, such that it lies parallel to the inner wall surface of the bottom coupling.

A single shear pin is mounted at the lower end of the sleeve. This pin is designed to engage the undersurface of the flapper disk, to hold the flapper closed while the tubing string is being lowered into the well casing. When fluid is passed downwardly through the valve assembly, the shear pin breaks off, to allow the flapper disk to open. If fluid backflows upwardly through the valve assembly from the well casing, it pushes the flapper disk into closed position.

When it is desired to remove the valve from the well casing a ball is dropped down the tubing string from the wellhead. The ball seats against the upper end of the mandrel to close off the central conduit. Fluid under pressure is pumped down the tubing string behind the ball, which forces the mandrel to slide downwardly from rest position to latch position. An expandable ring is carried in a groove on the mandrel. When the mandrel slides downwardly, the ring snaps outwardly and seats into another groove on the top coupling, and holds the mandrel in latch position. Also, as the mandrel moves downwardly, the lower end of the mandrel pushes the flapper disk open and holds it in open position.

DESCRIPTION OF A PREFERRED EMBODIMENT

Figure 1:
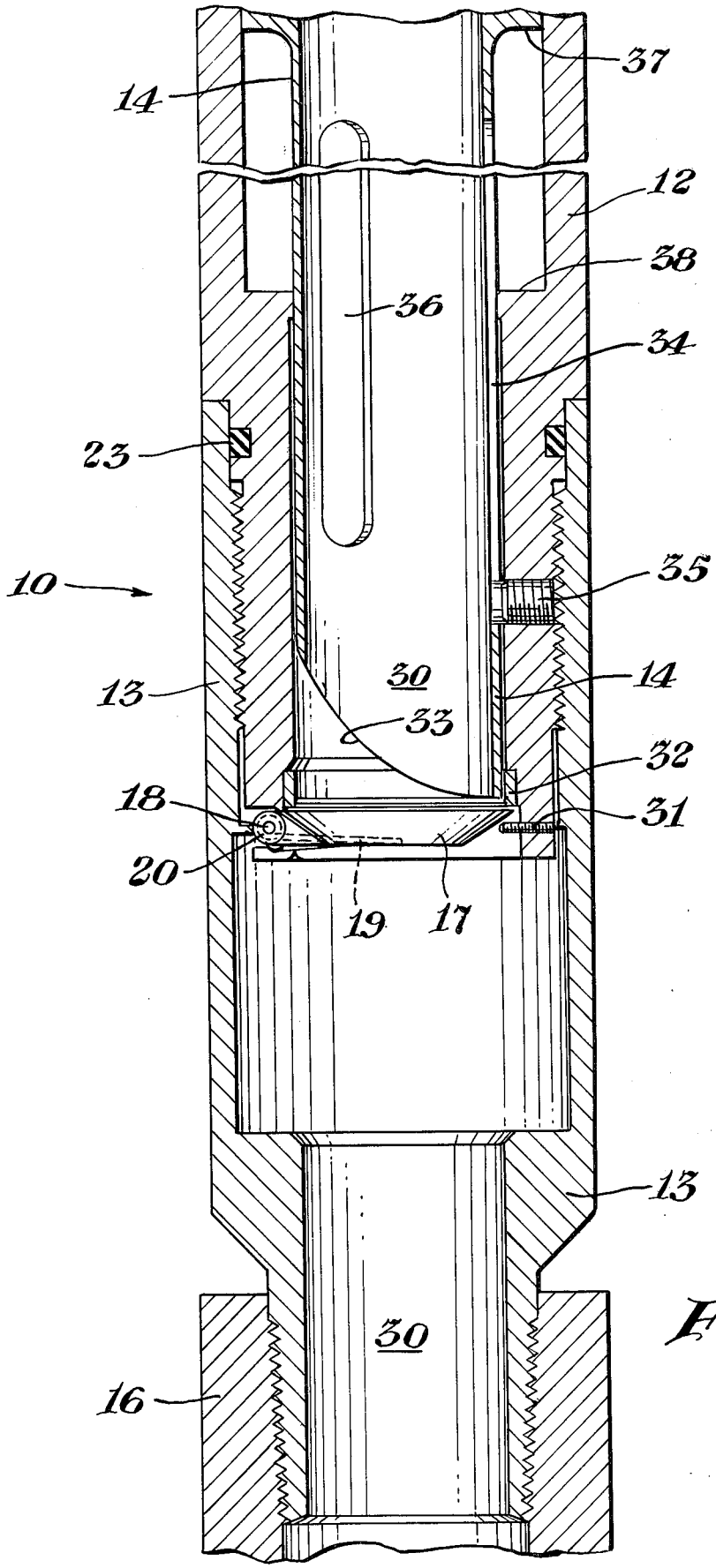
FIG. 1 is a partial view, in front elevation, and mostly in section, which illustrates the lower half of the valve assembly of this invention.

In the drawing, the valve assembly of this invention is generally indicated by the numeral 10. The basic valve assembly 10 is made up of a top coupling 11, a sleeve 12, a bottom coupling 13, and a hollow mandrel 14. The upper end of coupling 11 is threaded onto the lower end of a tubing string section 15. At its lower end coupling 11 is threaded into the upper end of sleeve 12.

The lower end of sleeve 12 makes a thread connection into the upper end of bottom coupling 13. The upper end of a second tubing string section 16 threads over the lower end of coupling 13. Mandrel 14 is fitted snugly into the top coupling 11 and sleeve 12, but it is a slide fit, which allows the mandrel to move downwardly from a rest position to a latch position, when sufficient force is applied to the upper end of the mandrel. In FIG. 1 of the drawing the mandrel is shown in its rest position.

As shown in FIG. 1, a flapper disk 17 is connected on one side to the inner wall surface of the bottom coupling 13, near the upper end of the coupling. The connecting structure for the flapper disk is a roll pin 18 and spring 19, which define a hinge point. One end of spring 19 is coiled around pin 18, with the opposite end of the spring seating in a groove (not shown) on the undersurface of disk 17. To describe the connection more specifically, pin 18 fits across a yoke member, indicated by numeral 20. The yoke is made up of two finger members, which seat into opposing recesses cut into the upper end of coupling 13. The finger members and recesses are not illustrated in specific detail in the drawing.

The valve assembly 10 includes O-ring seals, to prevent fluid from leaking into or out of the valve assembly. The uppermost seal is provided by O-ring 21, which is carried on the inner wall surface of coupling 11, and which engages mandrel 14. Another O-ring seal 22 is carried on the outer wall surface of mandrel 14, such that it engages sleeve 12. The third O-ring 23 is seated on sleeve 12, such that it engages the inner wall surface of coupling 13.

Figure 3:
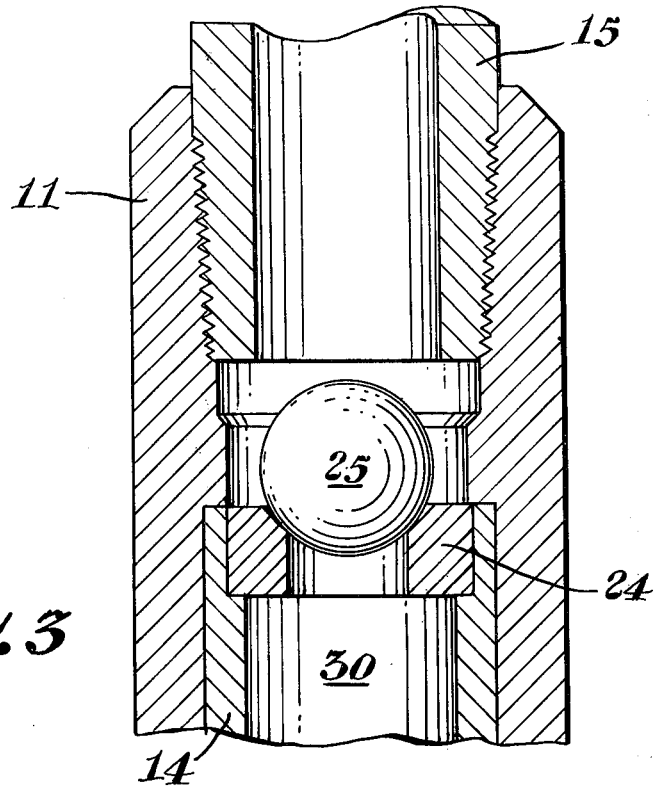
FIG. 3 is a fragmentary detail view, in front elevation, and mostly in section, illustrating a ball member designed to seat in the upper end of a mandrel component in the valve assembly shown herein.

An insert 24 is fitted into the upper end of mandrel 14. This insert provides means for a ball 25 to seat against the upper end of the mandrel, as shown in FIG. 3. In the operation of valve 10, the ball 25 is used to move the mandrel downwardly from its rest position. An expandable ring 26 is carried in a groove on the outer wall surface of mandrel 14. Below ring 26 is a second groove 27, which is cut into the inner wall surface of the lower end of top coupling 11. When the mandrel 14 moves downwardly to its latch position, ring 26 snaps outwardly to seat into groove 27. The actual procedure for moving the mandrel to its latch position is described in more detail later in this specification.

Figure 2:
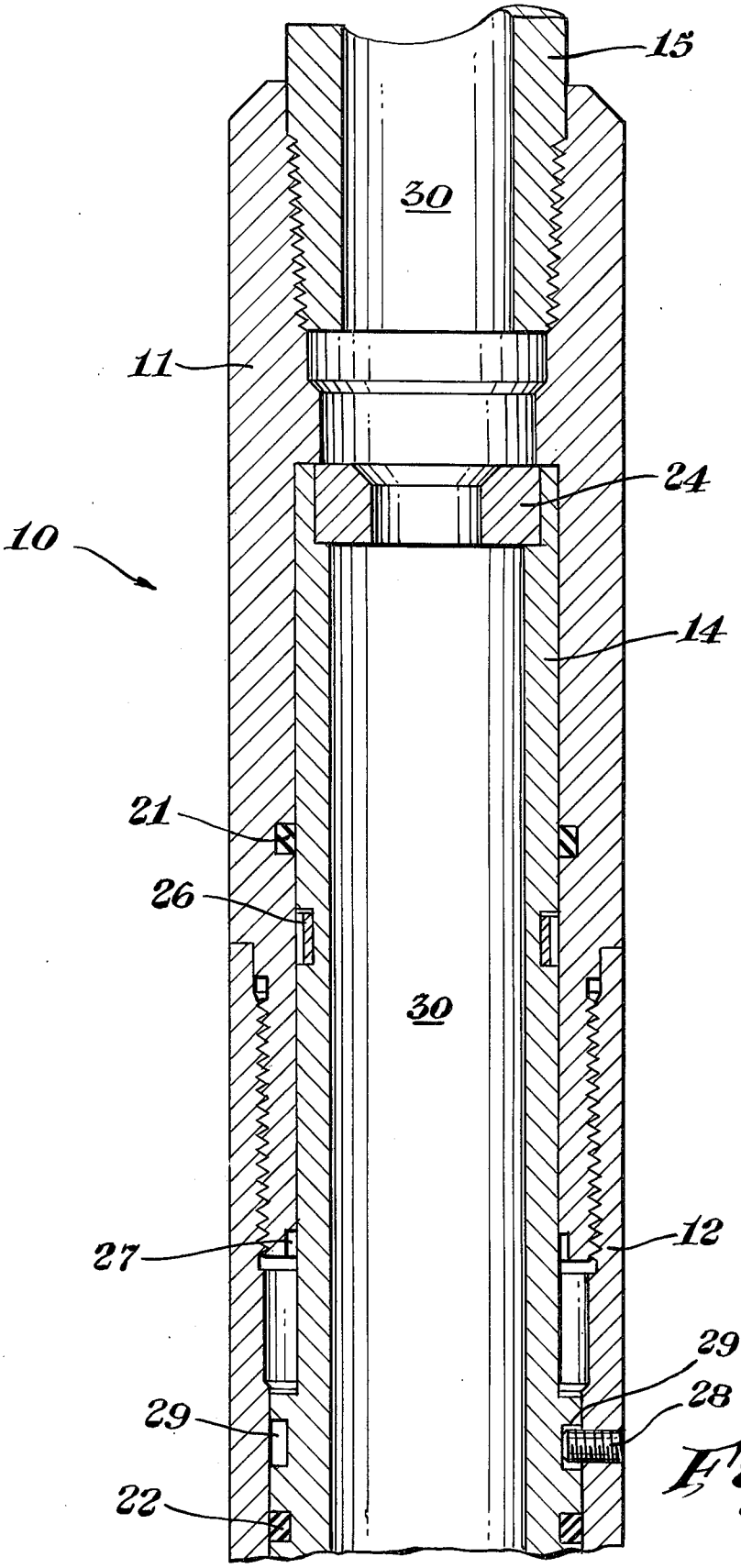
FIG. 2 is a partial view, in front elevation, and mostly in section, which illustrates the upper half of the valve shown in FIG. 1.

In FIGS. 1 and 2 mandrel 14 is shown in rest position. The mandrel is held in the rest position by three shear pins, which are mounted on sleeve 12 and which fit into recesses cut into the outer wall surface of the mandrel. In this valve assembly the shear pins are made up of brass screw studs. In FIG. 2 one of the screw studs 28 and two of the recesses 29 are illustrated.

A central conduit 30 is defined within the assembled combination of coupling 11, sleeve 12, coupling 13, and the hollow mandrel 14. Before fluid is pumped downwardly through the conduit 30 in valve 10, a single shear pin 31 holds the flapper disk 17 in a closed position. The pin 31, as shown in FIG. 1, is a brass screw. The screw is mounted at the lower end of sleeve 12, with its free end jammed against the undersurface of flapper disk 17. The top surface of the flapper disk seats against an insert 32, which is fitted into the inner wall surface of the lower end of sleeve 12.

Figure 4:
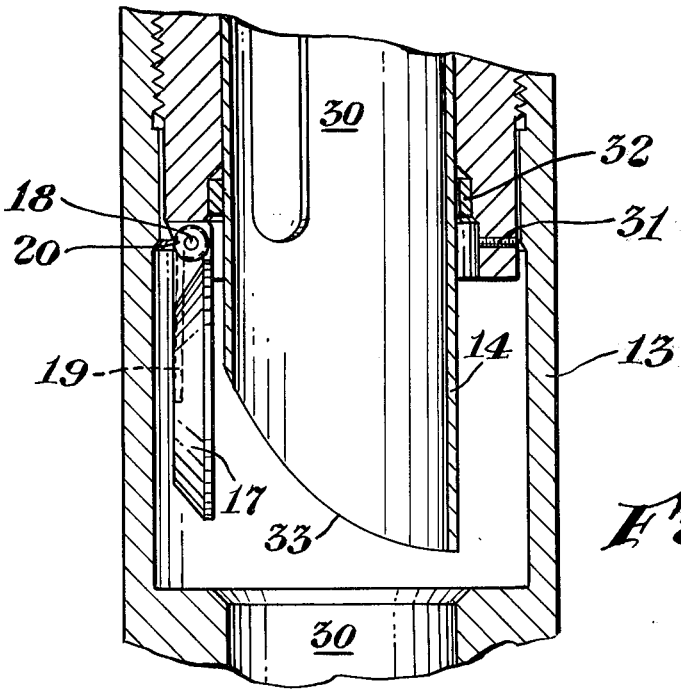
FIG. 4 is a fragmentary detail view, in front elevation, and mostly in section, which illustrates the lower end of the mandrel and a flapper disk positioned in the valve below the mandrel. In this view the flapper disk is shown in its open position.

The lower end of mandrel 14 has a curved surface 33, as shown in FIGS. 1 and 4. The curved surface thus forms a distinct point along one side of the lower end of the mandrel. When the mandrel is moved downwardly to open flapper 17 (FIG. 4), the mandrel point first hits the top side of the disk opposite to the hinge point. This eliminates excessive stress which could damage the hinge structure.

A vertical opening in the wall of mandrel 14 above the mandrel point provides a guide slot 34, as shown in FIG. 1. A screw plug 35 is mounted on sleeve 12, such that the free end of the plug makes a slide fit in slot 34. Plug 35 thus acts as a guide pin to insure that the mandrel 14 is properly positioned within the sleeve 12. In FIG. 1 another vertical opening 36 is shown in the wall of mandrel 14. The guide slot 34 is an opening having the same shape as the opening 36, but slot 34 is longer on its vertical dimension. in the practice of this invention, the opening 36 has no specific function in the operation of valve assembly 10, but the mandrel is fabricated such that it can be used in more than one tool assembly.

OPERATION

The valve assembly 10 is generally used in operations, such as acidizing or fracturing, which involve treating an earth formation with a liquid medium. To illustrate the practice of this invention, the use of the valve in a typical fracturing operation will now be described. At the start of the fracturing operation the valve 10 is assembled and connected into a tubing string, as illustrated in FIGS. 1 and 2. The entire tool unit used in the fracturing treatment generally includes the valve assembly 10, together with a well packer and retrievable bridge plug. The packer and bridge plug are not shown in the drawing.

The packer is fastened onto the tubing string 16 immediately below the valve 10, and the bridge plug sets on the tubing string below the packer. The tubing string is lowered into the well casing until the tool unit reaches the lowest interval in the formation to be treated. As the tubing string is lowered it passes through the residual fluids which are left in the casing, as mentioned earlier. When the tubing string is being lowered, the flapper disk 17 is held in closed position by the shear pin 31. This prevents the residual fluids from backflowing through the valve assembly.

When the tool reaches the first interval to be treated, the bridge plug is set in place below the casing perforations which communicate with the fractures in the formation. The tubing string is then disengaged from the bridge plug and the packer and valve 10 are raised, to set the packer above the casing perforations. Setting the bridge plug and packer seals off the casing annulus to prevent the residual fluid from moving into the treating zone. The fracturing fluid is then pumped down the tubing string, under pressure, to treat the formation interval. When the downwardly moving fluid passes through the conduit 30 in mandrel 14, it hits flapper 17 and shears off pin 31. The fluid pressure thus pushes the flapper disk downwardly to its open position.

After the first interval (lowest interval) is threaded, the tool unit is prepared for treating the next higher interval in the formation. Since the tubing string is filled with fracturing fluid after the first treatment, it is important to prevent residual fluid in the casing annulus from backflowing into the tubing string after the packer is unset to prepare for the second treatment. In the next step the packer is unset and the tubing string is lowered to retrieve the bridge plug. The tubing string is then raised, to set the bridge plug below the next interval, and the packer above the interval, in the same manner as described above.

While the tubing string is being raised to the higher interval, any fluid which by-passes the unset packer and the bridge plug will push upwardly through the open tubing string and force the flapper disk 17 to close. The flapper disk thus acts as a check valve to prevent the contaminating fluid from mixing with the fracturing fluid which remains in the tubing string. The procedure described above is repeated until all intervals have been treated.

After treatment of all intervals has been completed, the next step usually involves removing the tool unit from the well casing. This is done by first dropping a ball 25 into the tubing string, so that the ball seats into insert 24 at the upper end of mandrel 14. Fluid is then pumped down the tubing to apply downward pressure against the ball. The downward force causes the pins 28 to shear, which slides the mandrel 14 downwardly and opens the flapper disk 17, as shown in FIG. 4. The mandrel 14 moves down to a point at which a shoulder section 37 seats against a corresponding shoulder section 38 on sleeve 12. At the same point the ring 26 snaps outwardly and seats in groove 27 on coupling 11. This puts the mandrel in a latch position, so that it cannot move in either direction.

When the mandrel is in latch position, the flapper disk 17 is always in its open position, so that fluid can pass either upwardly or downwardly through the valve assembly 10. This makes it possible to float the ball 25 back to the wellhead by reverse circulation through the valve. It also enables the operating crew to pull the tubing string without bringing a "wet string" to the surface. This feature of the present valve also makes it convenient to leave the tool unit in the casing to perform an additional treatment, such as sand control. After the last operation is completed, the tubing string can be pulled to remove the tool unit.

The invention claimed is:

1. A valve assembly for controlling fluid flow through a tubing string positioned in a well casing, the valve assembly comprising:

a first coupling member having an upper end and a lower end, the upper end thereof being adapted for fastening into a first tubing string;

a sleeve member having an upper end and a lower end, the upper end thereof being fastened into the lower end of the first coupling member;

a second coupling member having an upper end and a lower end, the upper end thereof being fastened into the lower end of the sleeve member, and the lower end thereof being adapted for fastening into a second tubing string;

a hollow mandrel having an upper end and a lower end, the mandrel being positioned inside the first coupling and sleeve member, and slidable downwardly from a rest position to a latch position;

at least one upper shear pin which is mounted on the sleeve member above the lower end of the mandrel, and which engages the mandrel, to hold the mandrel in rest position;

a central conduit defined within the combined assembly of the first and second coupling members, the sleeve member, and the mandrel, the central conduit providing a passage for fluid to flow from one of the tubing strings to the other tubing string;

a flapper disk which has a pivot pin and spring structure mounted on one side of the disk, the pin and spring structure defining a hinge joint which connects the disk to the inner wall surface of the second coupling member, at the upper end of the second coupling;

the hinge joint permitting the flapper disk to move between a closed position and an open position, whereas in closed position the flapper disk will seat crosswise in the central conduit below the lower end of the mandrel, and in open position the flapper disk will swing downwardly and lie parallel to the inner wall surface of the second coupling;

a second shear pin which is mounted at the lower end of the sleeve member, and which engages the undersurface of the flapper disk, to hold the flapper disk in closed position prior to fluid flow downwardly through the valve assembly from the first tubing string;

whereas, when a fluid flows downwardly through the valve assembly, from the first tubing string, the flapper disk will assume the open position; and when a fluid backflows from the well casing upwardly through the valve assembly, from the second tubing string, the flapper disk will assume the closed position.

2. The valve assembly of claim 1 which further includes;

a ball member which seats against the upper end of the mandrel, to seal off the central conduit above the mandrel;

an expandable ring which seats in a first groove located on the outer wall surface of the mandrel below the upper end of the mandrel;

a second groove located on the inner wall surface of the first coupling member, at the lower end of said coupling member, the second groove defining a latch means for the expandable ring;

whereas, when fluid under pressure is directed downwardly against the ball member, the pressure forces the mandrel to slide downwardly from its rest position, which causes the first shear pin to break off, causes the lower end of the mandrel to push against the flapper disk and force it into open position, and causes the expandable ring to expand outwardly and seat into the second groove, to hold the mandrel in a latch position.

3. The valve assembly of claim 1 which further includes;

an elongate guide slot, which defines a vertical opening in the mandrel wall above the lower end of the mandrel; and a guide pin which is secured to the wall of the sleeve member, the pin having a free end which projects inwardly and slidably engages the guide slot.

4. The valve assembly of claim 1 in which the lower end of the mandrel is defined by a curved surface, the curved surface thus forming a distinct point at one side of the lower end of the mandrel.

* * * * *